United States Patent [19]

Bonolis

[11] Patent Number: 4,526,499

[45] Date of Patent: Jul. 2, 1985

[54] RAIL LOCK

[76] Inventor: Vincent P. Bonolis, 7841 St. Claire La., Baltimore, Md. 21222

[21] Appl. No.: 531,719

[22] Filed: Sep. 13, 1983

[51] Int. Cl.[3] ..... B61D 3/16; B61K 7/16

[52] U.S. Cl. ..... 410/31; 410/121; 188/36; 414/507; 104/250; 104/257

[58] Field of Search ..... 410/31, 2, 121, 156; 104/249, 250, 254, 257, 258; 269/246; 248/231.1; 188/36, 37; 414/467, 507

[56] References Cited

U.S. PATENT DOCUMENTS

| | | | |
|---|---|---|---|
| 1,254,683 | 1/1918 | Grapevine | 104/250 |
| 2,008,440 | 7/1935 | Fisher | 269/246 X |
| 3,109,544 | 11/1963 | Learmont | 104/250 X |
| 3,138,114 | 6/1964 | Knippel | 104/250 X |

*Primary Examiner*—Randolph A. Reese
*Assistant Examiner*—Glenn B. Foster
*Attorney, Agent, or Firm*—Leonard Bloom

[57] ABSTRACT

An improved rail lock for the meat transportation industry has a pair of legs which extend below the rail. The inner surface of one of the legs is substantially flush against a side of the rail. A first clamping means is carried by the other leg and bears against the other side of the rail, thereby exerting a force tending to spread the legs apart. A second clamping means is carried by the one leg, just below the rail, and exerts a counterforce tending to bring the legs together. As a result, the rail lock is rigidly retained on the rail and will not vibrate loose during transportation, thereby solving a vexatious problem in the meat industry.

5 Claims, 6 Drawing Figures

RAIL LOCK

The present invention relates to a rail lock, and more particularly, to an improved rail lock for meat suspended from a trolley slidably mounted on an overhead rail.

BACKGROUND OF THE INVENTION

In the meat industry, refrigerated trucks or railroad cars are used to transport dressed sides of beef or other meat. The sides of beef are suspended by a shackle having a trolley that rides along an overhead rail. In a typical truck, there are four parallel overhead rails, each of which may support around ten sides of beef, for a total of around forty sides of beef per truck. At roughly 400 pounds per side of beef, the total load will be 16,000 pounds (or 8 tons) for a forty-foot tractor trailer.

In order to keep the load from shifting endwise along the overhead rail, I made a rail lock and applied it to the end of each rail. This prior rail lock was substantially U-shaped and consisted of a central section having a pair of spaced-apart depending legs welded thereto or formed integrally therewith. This prior rail lock was placed over the rail, such that the central section thereof was supported on the top edge of the rail, and such that the inner face of one of the legs thereof was substantially flush against one side of the rail. The legs of the rail lock terminated short of the rail. The other leg of the rail lock carried a clamping screw, transversely thereof, and the end of the clamping screw engaged against the other side of the rail to clamp the rail lock to the rail. The rail lock thus served as a stop to keep the sides of beef from shifting endwise along the rail.

Problems have been encountered repeatedly, however, with the use of this prior rail lock. The clamping screw tended to loosen, especially due to the continuous vibration of the truck over the highways, and the load tended to "bounce" back and forth along the rail. In aggravated situations, a hazard was created which may cause the truck to "jackknife" along a curve due to the shifting load. Very often, the driver had to stop the truck, open the doors, and apply a pipe or other implement in an attempt to retighten the existing rail lock. In some cases, the driver had to make several stops. This increased delivery time and besides, opening the doors interfered with or reduced the refrigeration of the meat, thus wasting energy. Moreover, repeatedly tightening the clamping screw with an elongated pipe caused the welds in the central section of the rail lock to fracture, thus destroying the rail lock.

Despite the numerous clamps and stops available in the prior art, which are for different purposes, no one to date has been able to solve the aggravating, time-consuming and costly problems associated with the devices resorted to in the meat transportation industry.

SUMMARY OF THE INVENTION

Accordingly, it is an object of the present invention to alleviate the disadvantages and deficiencies of the prior art by providing an improved rail lock for the transportation of sides of beef or the like in the meat industry.

It is another object of the present invention to stabilize the meat, prevent endwise bouncing or shifting of the load, and thus substantially reduce (if not eliminate) the road hazards.

It is yet another object of the present invention to provide an improved rail lock that may be used easily and conveniently, yet may be manufactured economically for widespread usage.

In accordance with the teachings of the present invention, the depending legs of the rail lock (which straddle the rail) extend below the rail. The inner surface of one of the legs is substantially flush against one of the sides of the rail. A first clamping means is carried by the other leg and engages the other side of the rail, whereby the first clamping means exerts a force tending to move the legs apart. A second clamping means is carried by the legs below the rail and exerts a counterforce tending to bring the legs together, thereby rigidly retaining the rail lock on the rail.

In accordance with the further teachings of the present invention, the second clamping means (which extends just below the rail) is tightened before the first clamping means. Each of the clamping means includes an elongated clamping screw (or bolt) and further includes a handle accessible externally of the respective legs.

These and other objects of the present invention will become apparent from a reading of the following specification, taken in conjunction with the enclosed drawings.

GENERAL DESCRIPTION OF THE PREFERRED EMBODIMENT

Figure 1:
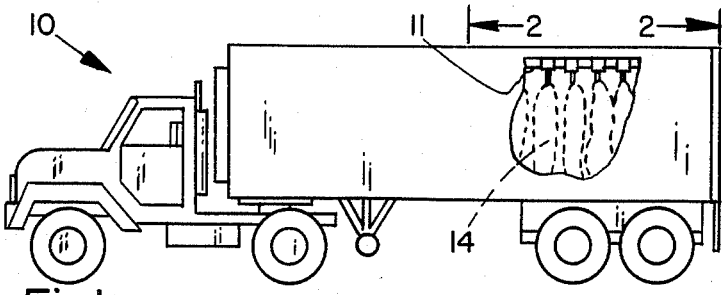
FIG. 1 is a side elevation of a typical refrigerated truck used in the meat transportation industry, the side panel of the truck being broken away to show the sides of beef, each of which is suspended by a shackle connected to a trolley riding on an overhead rail.
Figure 3:
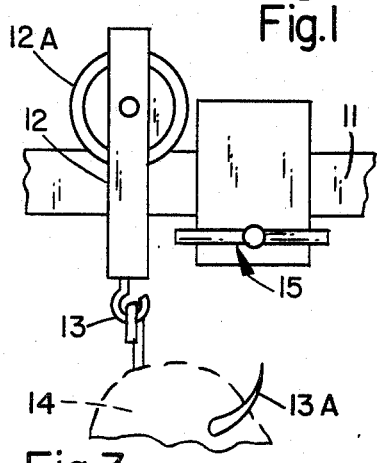
FIG. 3 is a side elevation of the trolley and the improved rail lock of the present invention, the view being taken along the lines 3—3 of FIG. 2.
Figure 2:
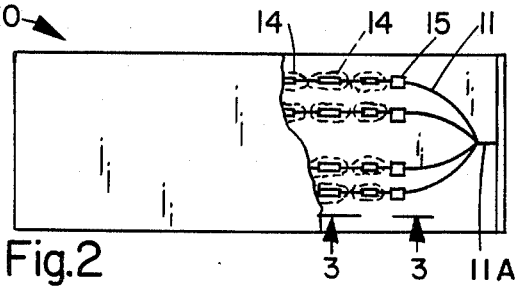
FIG. 2 is a partial top plan view thereof, with part of the trailer roof being broken away to show the four overhead rails.

With reference to FIGS. 1-3 there is illustrated a typical refrigerated truck 10 (constituting a forty-foot tractor trailer) with which the teachings of the present invention may find more particular utility. However, it will be appreciated by those skilled in the art, that the invention is equally applicable to other refrigerated trucks or railroad cars, as well as other forms of transportation or storage used in the meat industry. The truck may be provided with a number of overhead rails 11 (preferably four in number, as shown) which merge with a single discharge rail 11A at the back of the trailer. A plurality of trolleys 12 having rollers 12A are slidably mounted on the overhead rails. Each trolley has an eyelet 13 (or an equivalent shackle) provided with a hook 13A for slidably suspending a side of beef 14 or other meat.

Figure 4:
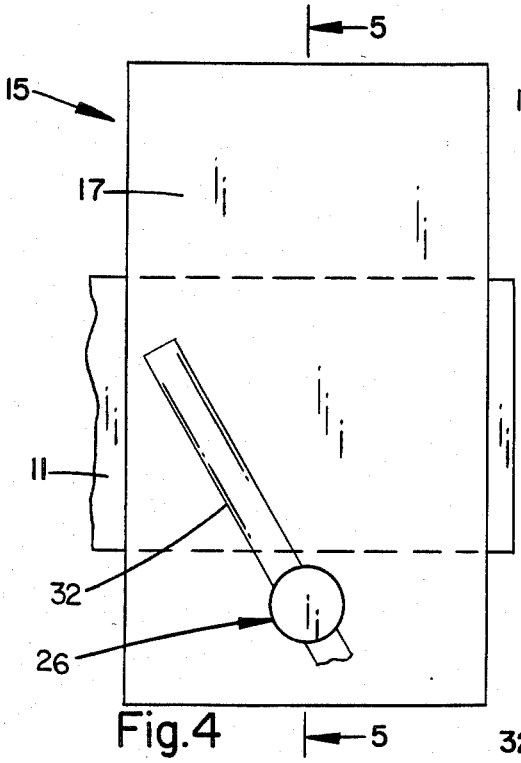
FIG. 4 is a side elevation of the improved rail lock of the present invention, the view being enlarged in scale.
Figure 5:
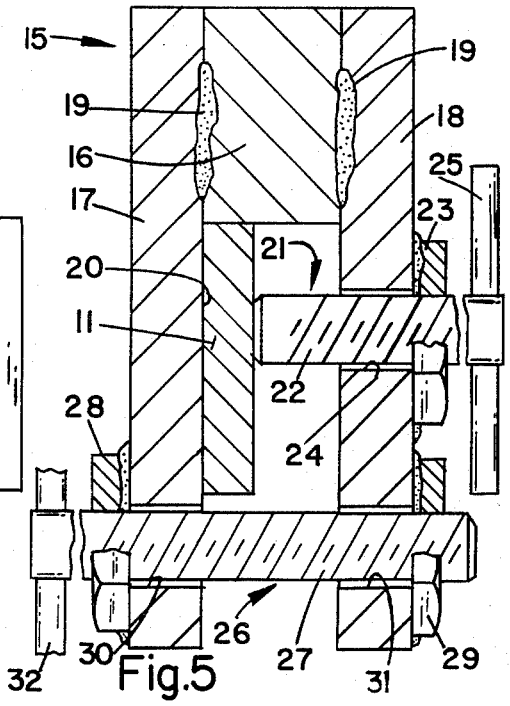
FIG. 5 is a section view of the improved rail lock, taken along the lines 5—5 of FIG. 4.

With reference to FIGS. 3-5, a rail lock 15 (preferably made of steel) is provided at the end of each rail.

This rail lock is a substantially inverted U-shaped member having a central section 16 and a pair of parallel spaced-apart legs 17 and 18 depending therefrom. The legs may be secured to the central section by welds 19 or otherwise formed integrally with the central section. The central section of the rail lock is supported on the top edge of the rail (as shown in FIG. 5) and the depending legs straddle the rail and (as distinguished from the prior rail lock) extend therebelow. The inner surface 20 of the one leg 17 is substantially flush against one side of the rail.

A first clamping means 21 is carried by the other leg 18. The first clamping means includes an elongated first clamping screw (or bolt) 22 threadably engaging a nut 23 welded to the side of the leg 18. The first clamping screw passes through a hole 24 in the leg 18, and the end of the first clamping screw engages the other (exposed) side of the rail. A first clamping element constituting a T-handle 25 (or other handle means) is carried on the end of the first clamping screw and is accessible externally of the leg 18. If desired, the hole 24 could be threaded, in which case the nut 23 would not be necessary.

A second clamping means 26 is carried by the one leg 17, preferably just below the bottom edge of the rail. This second clamping means includes an elongated second clamping screw (or bolt) 27 threadably engaging respective nuts 28 and 29. Nut 28 is welded to leg 17, and nut 29 is welded to leg 18. The second clamping screw passes through aligned holes 30 and 31 formed in the legs 17 and 18, respectively. If desired, the holes 30 and 31 could be threaded, in which case nuts 28 and 29 would not be necessary. A second clamping element constituting a T-handle 32 (or other handle means) is carried by the second clamping screw.

Thus it will be appreciated that the first clamping means 21 exerts a force tending to move the legs 17 and 19 apart, while the second clamping means exerts a counterforce tending to bring the legs together. As a result, the improved rail lock is rigidly retained on the rail. Preferably, the second clamping means is tightened before the first clamping means, but in practice it is possible to alternately tighten first one of the clamping means and then the other, and to repeat the sequence until the rail lock is very rigidly secured.

Figure 6:
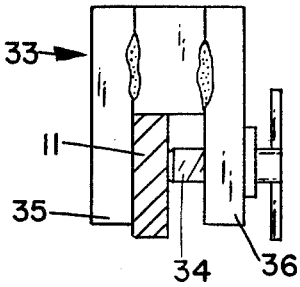
FIG. 6 is a section view, drawn to a reduced scale, of my prior rail lock.

The prior rail lock, which I had used before, is illustrated at 33 in FIG. 6. There, only one clamping screw 34 is provided, and the legs 35 and 36 terminate short of the rail 11. About eight or ten of these prior rail locks were required on a "forty footer" (tractor trailer); these prior rail locks were spaced along the rails, and even then didn't do the job. With the present invention, only four improved rail locks are required; these are located at the ends of the rails as shown in FIG. 2.

Accordingly, the improved rail lock of the present invention has solved a problem of long standing in the meat transportation industry and has proven to be effective under difficult field conditions, yet is simple and economical to manufacture.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A rail lock for meat suspended from a trolley means slidably mounted on an overhead rail, wherein the rail has a top edge and a bottom edge, comprising a member having a central section disposed above the rail and further having a pair of depending legs carried by the central section, the legs straddling the rail and extending therebelow, whereby the inner surface of one of the legs is substantially flush against a side of the rail, first clamping means carried by the other leg and engaging the other side of the rail, the first clamping means including a first clamping element accessible from the outer face of the other leg, whereby the first clamping means exerts a force tending to move the legs apart, and second clamping means carried by the legs below the rail and exerting a counterforce tending to bring the legs together, thereby rigidly retaining the rail lock on the rail, the second clamping means including a second clamping element accessible from the outer face of the one leg, whereby the first and second clamping elements are on opposite sides of the rail lock, thereby precluding any interference between the trolley means and the first and second clamping means, and wherein the second clamping means further includes a bolt disposed just below the bottom edge of the rail, the arrangement being such that when the trolley means bangs against the rail lock, the rail lock will not pivot sufficiently to allow the trolley means to ride up over the rail lock.

2. The rail lock of claim 1, wherein the first clamping member includes a handle member accessible externally of the other depending leg, and wherein the second clamping member includes a handle member accessible externally of the one leg.

3. The rail lock of claim 1, wherein the second clamping means is tightened before the first clamping means.

4. The rail lock of claim 1, wherein each of the clamping means includes a respective elongated bolt.

5. A rail lock for meat suspended from a trolley means slidably mounted on an overhead rail, wherein the rail has a top edge and a bottom edge, comprising an inverted substantially U-shaped member having a central section disposed above the rail and contacting the top edge thereof, the member further having a pair of spaced-apart parallel legs formed integrally with the central section, depending therefrom, and straddling the rail and extending therebelow, whereby the inner surface of one of the legs is substantially flush against one side of the rail, first clamping means including a first elongated bolt carried by the other leg and engaging the other side of the rail, first handle means carried by the first bolt and accessible externally of the outer face of the other depending leg, whereby the first handle means exerts a force tending to move the legs apart, second clamping means including a second elongated bolt carried by the legs and disposed just below the bottom edge of the rail, the arrangement being such that when the trolley means bangs against the rail lock, the rail lock will not pivot sufficiently to allow the trolley means to ride up over the rail lock, and second handle means carried by the second bolt, whereby the second clamping means exerts a counterforce tending to bring the legs together, thereby rigidly retaining the rail lock on the rail and preventing loosening of the rail lock and consequent shifting of the meat during transportation thereof, the second handle means being accessible from the outer face of the one depending leg, wherein the first and second handle means are on opposite sides of the rail lock, thereby preventing any interference between the trolley means and the first and second handle means.

* * * * *